US007438490B2

(12) United States Patent
Dumler

(10) Patent No.: US 7,438,490 B2
(45) Date of Patent: Oct. 21, 2008

(54) CONTAINER AND APPLICATOR UNIT

(75) Inventor: Norbert Dumler, Ansbach (DE)

(73) Assignee: Geka Brush GmbH, Bechhofen-Waizendorf (DE)

( * ) Notice: Subject to any disclaimer, the term of this patent is extended or adjusted under 35 U.S.C. 154(b) by 0 days.

(21) Appl. No.: 11/641,059

(22) Filed: Dec. 19, 2006

(65) Prior Publication Data

US 2007/0110509 A1 May 17, 2007

Related U.S. Application Data

(62) Division of application No. 11/250,512, filed on Oct. 17, 2005, now abandoned, which is a division of application No. 10/656,505, filed on Sep. 8, 2003, now abandoned.

(30) Foreign Application Priority Data

Sep. 6, 2002 (DE) ..... 102 41 218

(51) Int. Cl.
*B43K 5/14* (2006.01)
*A46B 11/04* (2006.01)
*A45D 24/22* (2006.01)

(52) U.S. Cl. ..... 401/134; 401/284; 401/287; 401/268; 132/114

(58) Field of Classification Search ..... 401/198, 401/199, 291, 270, 286, 284, 287, 132–134, 401/268; 132/113, 114, 115
See application file for complete search history.

(56) References Cited

U.S. PATENT DOCUMENTS 933,274 A 9/1909 Swanberg
3,090,070 A 5/1963 Simons
3,147,757 A * 9/1964 Hofmann ..... 132/114
4,747,720 A 5/1988 Bellehumeur et al.
4,846,201 A 7/1989 Fuchs et al.
5,338,605 A * 8/1994 Noland et al. ..... 428/398
5,567,073 A 10/1996 deLaforcade et al.
5,772,347 A 6/1998 Gueret
6,062,230 A 5/2000 Kajgana
6,071,029 A * 6/2000 Weinstock ..... 401/158

(Continued)

FOREIGN PATENT DOCUMENTS

DE 35 38 653 5/1987

(Continued)

OTHER PUBLICATIONS

Translation of DE 3538653 May 14, 1987.*

*Primary Examiner*—David J Walczak
(74) *Attorney, Agent, or Firm*—Browdy and Neimark, P.L.L.C.

(57) ABSTRACT

A container and applicator unit, in particular test unit, comprises a container for a cosmetic. An applicator top is placed thereon, having an applicator that stands out from the top in a principal sense of extension. The applicator, at least by sections, is rotationally symmetrical or plurally symmetrical in relation to an axis of symmetry that is parallel to the principal sense of extension. At least one passage, which, at least by sections, is decentralized from the axis of symmetry of the applicator, leads from the container to the applicator. The result is a container and applicator unit by which to enable a cosmetic to be spread uniformly on the surface of application.

6 Claims, 6 Drawing Sheets

U.S. PATENT DOCUMENTS

| | | | | |
|---|---|---|---|---|
| 6,161,978 | A | 12/2000 | Dovellos | |
| 6,224,287 | B1 | 5/2001 | Gieux | |
| 6,238,117 | B1 | 5/2001 | Griebel et al. | |
| 6,260,557 | B1 | 7/2001 | Yarbrough | |
| 6,280,113 | B1 * | 8/2001 | Gueret | 401/122 |
| 6,477,732 | B1 * | 11/2002 | Cline et al. | 15/185 |

FOREIGN PATENT DOCUMENTS

| | | |
|---|---|---|
| DE | 37 08 051 | 9/1987 |
| DE | 88 02 744.9 | 6/1988 |
| DE | 40 05 419 | 8/1991 |
| DE | 196 47 617 | 5/1998 |
| DE | 197 44 181 | 4/1999 |
| DE | 694 19 481 | 11/1999 |
| FR | 22 15 915 | 8/1974 |
| FR | 2 727 609 | 7/1996 |
| JP | 10 192048 | 7/1998 |
| WO | WO 88/04148 | 6/1988 |

* cited by examiner

CONTAINER AND APPLICATOR UNIT

This is a division of parent application Ser. No. 11/250,512, filed Oct. 17, 2005, now abandoned, which is a divisional of Ser. No. 10/656,505, filed Sep. 8, 2003, now abandoned.

BACKGROUND OF THE INVENTION

1. Field of the Invention

The invention relates to a container and applicator unit, in particular test unit, comprising a container for a cosmetic; an applicator top that is placed on the container, having an applicator which stands out therefrom in a principal sense of extension and which, at least by sections, is rotationally or plurally symmetrical in relation to an axis of symmetry and a center line, respectively, that is parallel to the principal sense of extension; and at least one passage that leads from the container to the applicator.

2. Background Art

Units of the generic type for applying mascara to eyebrows or nail enamel to finger nails are familiar in the cosmetic field, which the following makes reference to by way of example. Nail enamel units regularly comprise a bottle made of glass, on which to screw a cap with a brush or some other bunch of fibers as an applicator. Mascara units also comprise a container for liquid mascara, with a screw-on cap having a stem with a brush of a plurality of bristles that are held between intertwisted wire segments. Numerous further designs of containers and applicators have been known, for instance applicators in the form of foam molded parts.

Regarding the uniformity of application behavior by way of available applicator spreading surfaces, container and applicator units of the species still are in need of improvement, in particular in the light of an ever increasing demand of the market for smaller and/or testing sets.

SUMMARY OF THE INVENTION

It is an object of the invention to further develop a container and applicator unit of the type mentioned at the outset for as uniform an application as possible of a cosmetic.

According to the invention, this object is attained in a container and applicator unit wherein an at least one passage is decentralized, at least by sections, in relation to the axis of symmetry and center line, respectively, of the applicator.

The at least one decentralized passage, which may be provided in addition to a central passage, enables even decentralized areas of the applicator to be charged with the cosmetic so that, on the whole, a greater applicator spreading surface is available for uniform application of the cosmetic. The number of passages, their grouping and cross-sectional design can be embodied in accordance with the shape of the applicator.

Preferably, provision is made for a plurality of passages side by side in a row. This aids in large-surface charging of the applicator with a cosmetic, which again improves the uniformity of application.

The applicator may further consist of comparatively soft material, such as rubber, thermoplastic elastomer, of a respective Shore hardness A of 5 to 100; PU/PE foam material of a pore count of approximately 40 to 100 ppi; or rubber, TPE or PVC, with artificial silk, rayon or polyamide flock coating. These materials have proved well suited for uniform spreading.

The at least one passage may be a supply line that discharges by the applicator's side, projects beyond the applicator top and terminates in particular in the vicinity of the front end of the applicator. A passage of this type enables an area, turned towards the surface of application, of the applicator to be charged with a cosmetic. In this way, any cosmetic, consumed by the applicator for spreading, can be replaced promptly so that there is no interruption in the application process.

The end of the at least one passage may have an outlet that is skewed towards the applicator. In this way, the at least one passage is moved as closely as possible towards the applicator for it to be optimally charged with a cosmetic.

The at least one passage can also discharge into the tubular interior of the applicator top by a tip of in particular skewed design, with an initially central passage, which proceeds from the applicator top, then branching into a plurality of at least in part decentralized passages and mouthing into a plurality of decentralized outlets. The skewed tip of the applicator is of special assistance in application techniques in which the applicator is placed at an angle on the surface of application. The plurality of decentralized passages work in favor of charging the applicator uniformly with a cosmetic.

The outlets may be covered by thin membranes of plastic or sealing material, for example hot-melt adhesive, which are removable when the unit is put to use, in particular by peeling, cutting or the like. In this embodiment, the applicator top can be designed as a closed unit prior to first use.

Preferably, the applicator further comprises a plurality of hollow fibers which serve as passages, having a plurality of decentralized outlets. This kind of design of,the applicator also aids in uniform cosmetic dispensing.

Further, a central passage can open into a distribution passage with a plurality of outlets for a brush-type applicator. The distribution passage, which is the decentralized passage in this embodiment, enables the brush-type applicator to be charged uniformly with a cosmetic.

The outlets may be enveloped in the shape of a U by the core of an applicator brush. A design of this type is suitable in particular upon use of the container and applicator unit as a mascara unit.

In keeping with another embodiment, the applicator may comprise a plurality of individual fibers, at least the free ends of which are treated or coated with an anti-adhesive layer, for example Teflon (PTFE). This prevents clotting of the applicator.

Details of the invention will become apparent from the ensuing description of exemplary embodiments, taken in conjunction with the drawing.

DESCRIPTION OF PREFERRED EMBODIMENTS

Figure 3:
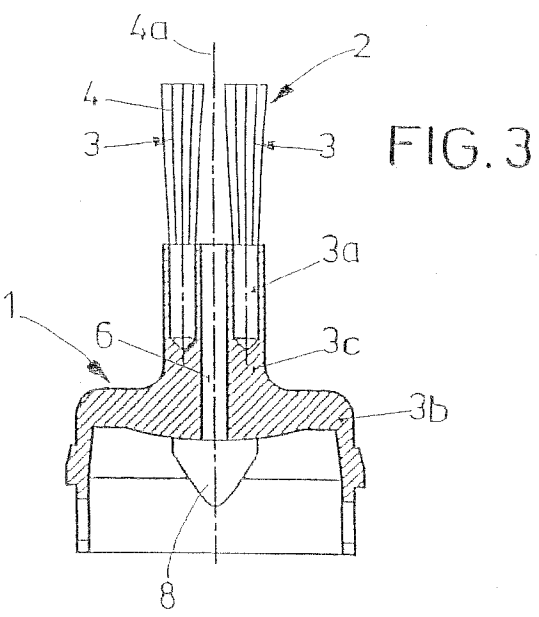
FIG. 3 is a section on the line III-III of FIG. 1.
Figure 2:
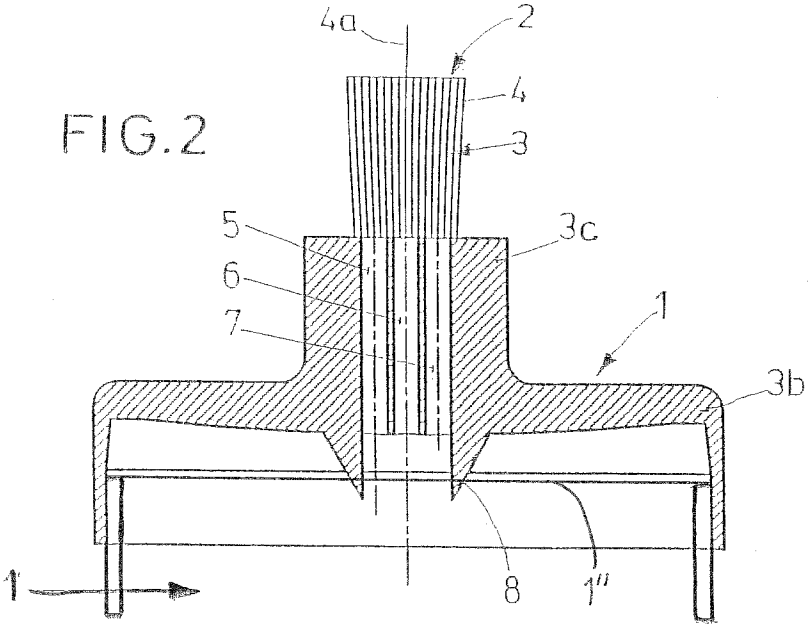
FIG. 2 is a section on the line II-II of FIG. 1.
Figure 1:
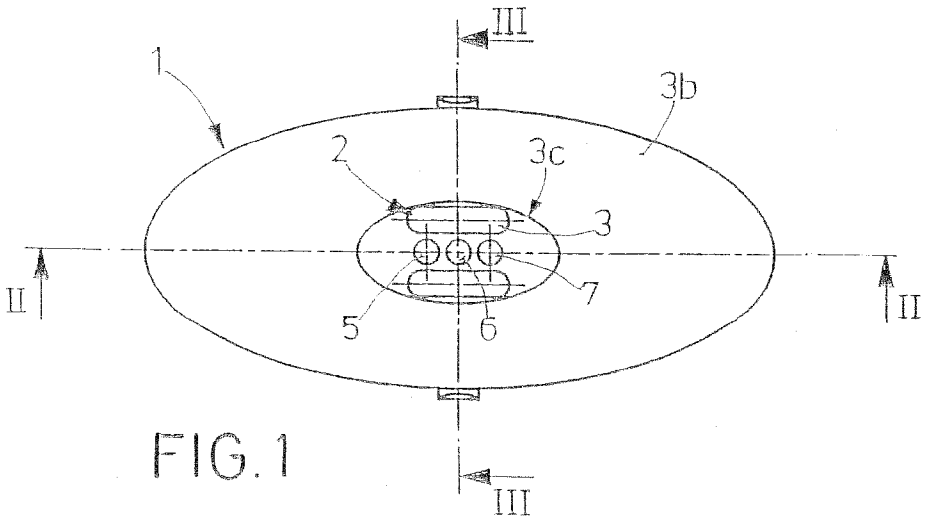
FIG. 1 is a plan view of the applicator side of an applicator top of a cosmetic or medical container and applicator unit.

FIGS. 1 to 3 illustrate a first embodiment of an applicator top 1 with an applicator 2 for spreading a cosmetic or medical substance, for example mascara or hair dyes on eyebrows or nail enamel on finger nails. For use, the applicator top 1 is placed on a container 1' shown only in FIG. 2.

The applicator 2 comprises two applicator tips 3 which are connected to the applicator top 1 in a manner known per se and embodied as bunches of fibers of a cross-sectional shape of a stadium. To this end, the applicator tips 3 are glued or stamped into blind holes 3*a* which are provided in a cross-sectionally oval projection 3*c* of the applicator top 1 that stands out from the base 3*b* of the applicator top 1. The applicator tips 3 are composed of a multiplicity of individual fibers 4. The surfaces of the applicator tips 3 can be treated or coated with an antiadhesive layer, such as Teflon (PTFE).

The individual fibers 4 stand out from the projection 3*c* in a principal sense of extension 4*a* that is plotted by a dot-dashed line in FIG. 2. In relation to a center line, or axis of symmetry, that is parallel to, or coincides with, the principal sense of extension 4*a*, the applicator 2 is dually symmetric by reason of its two applicator tips.

FIGS. 1 and 3 illustrate that the applicator tips 3 are spaced apart where the individual fibers 4 extend from the projection 3*c*. In this interstice between the two applicator tips 3, provision is made in the projection 3*c* for three parallel passages 5, 6, 7. In relation to the axis of symmetry 4*a* of the applicator 2, the outer passages 5, 7 are decentralized. The passages 5, 6, 7 line up side by side in a row, with a line that unites this row running parallel to the longitudinal axis of the cross-sectional stadiums formed by the applicator tips 3.

The passages 5, 6, 7 have a round cross-sectional shape, extending in parallel to the principal sense of extension 4*a*. When the applicator top 1 has been placed on the container, they connect the inside of the container to the space between the applicator tips. Where the passages 5, 6, 7 discharge in the direction towards the container, two wedge-shaped cutting edges 8 are provided on the applicator top 1, which are integrally united with the base 3*b*.

The applicator top 1, together with the applicator 2 of FIGS. 1 to 3, is inserted as follows:

At first, the applicator top 1 is placed by its base 3*b* on the container that is still closed then. The cutting edges 8 as shown in FIG. 2 pierce a correspondingly perforated upper wall 1" of the container so that a connection is created between the interior of the container and the passage 5 to 7. Afterwards, a cosmetic, for example nail enamel, can be applied by way of the applicator 2. In this case, the applicator top 1 is held in a position for the cosmetic to pass through the passages 5, 5, 7 into the interstice between the applicator tips 3. The cosmetic then spreads uniformly over the entire width of the applicator tips 3.

Further embodiments of applicator tops with applicators will be described in the following, taken in conjunction with FIGS. 4 to 19. Components that correspond to those already described in conjunction with previous designs have the same reference numerals and will not be explained in detail once again.

Figure 6:
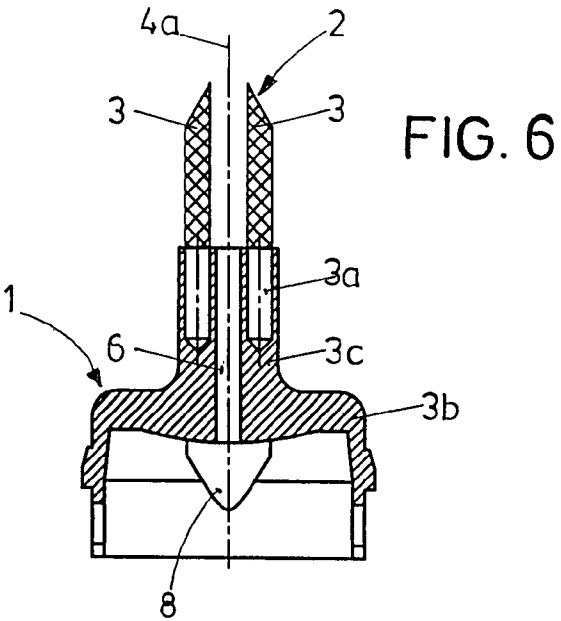
FIG. 6 is a section on the line VI-VI of FIG. 4.
Figure 5:
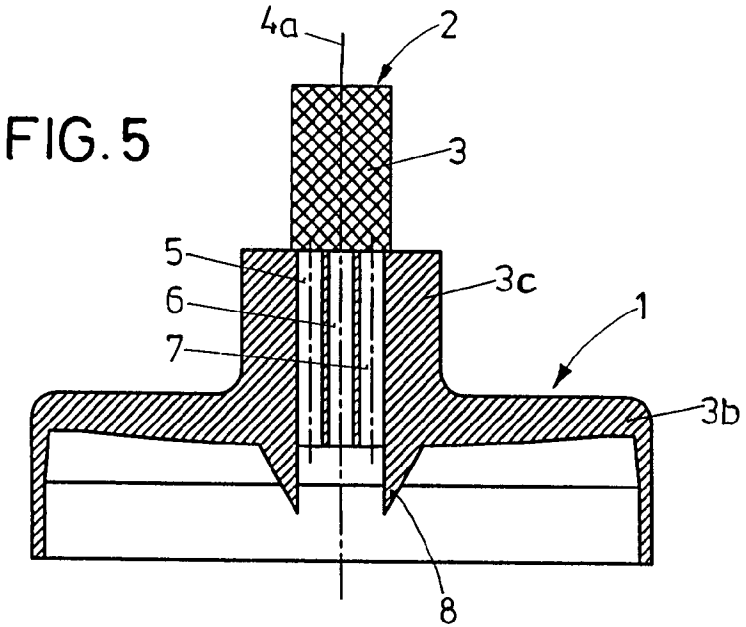
FIG. 5 is a section on the line V-V of FIG. 4.
Figure 4:
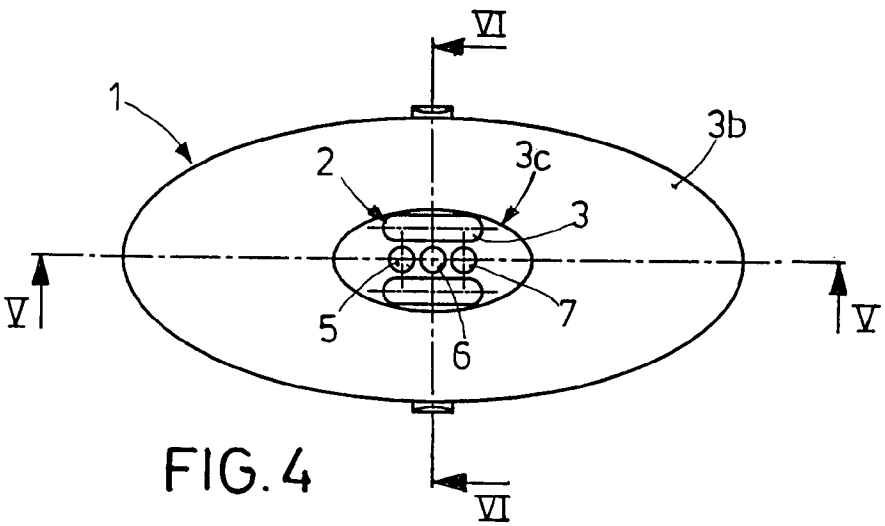
FIG. 4 is a view, similar to FIG. 1, of another container and applicator unit.

FIGS. 4 to 6 illustrate a second embodiment of a container and applicator unit which differs from the first embodiment by the shape and material of the applicator tips 3. FIG. 6 illustrates that the free ends of the applicator tips 3 are skewed in the shape of a wedge so that their maximum length is contiguous to the passages 5, 6, 7.

In the second embodiment, the applicator tips 3 consist of rubber of a Shore hardness A of 5 with a flock coating of artificial silk. By alternative, provision may also be made for a flock coating of rayon or polyamide. It is also conceivable to provide a Shore hardness A in a range between 5 and 100 instead of a Shore hardness of 5. Instead of rubber, the applicator tips 3 may consist of a thermoplastic elastomer TPE of the same range of Shore hardness or of a PU/PE foam with a pore count of approximately 40 to 100 ppi or of soft PVC. The flock coating can be dropped.

Figure 9:
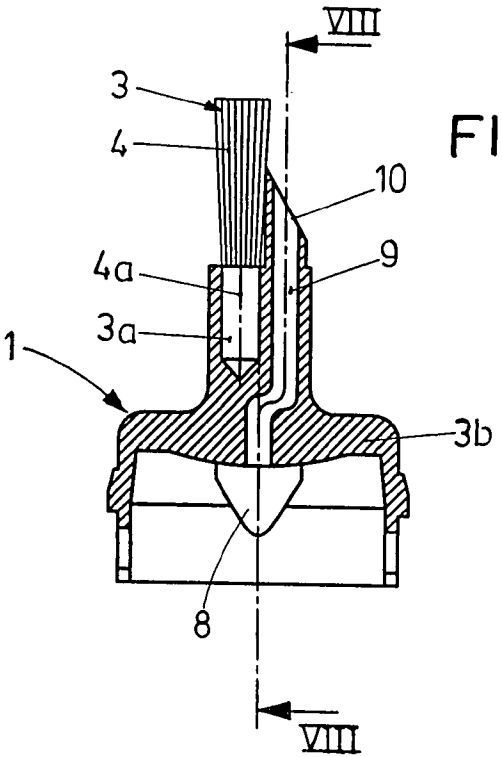
FIG. 9 is a section on the line IX-IX of FIG. 7.
Figure 8:
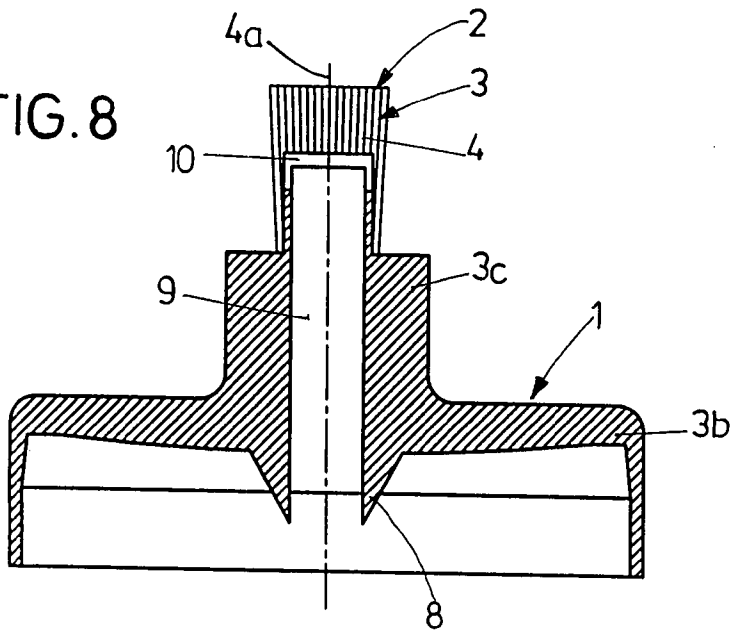
FIG. 8 is a section on the line VIII-VIII of FIG. 9.
Figure 7:
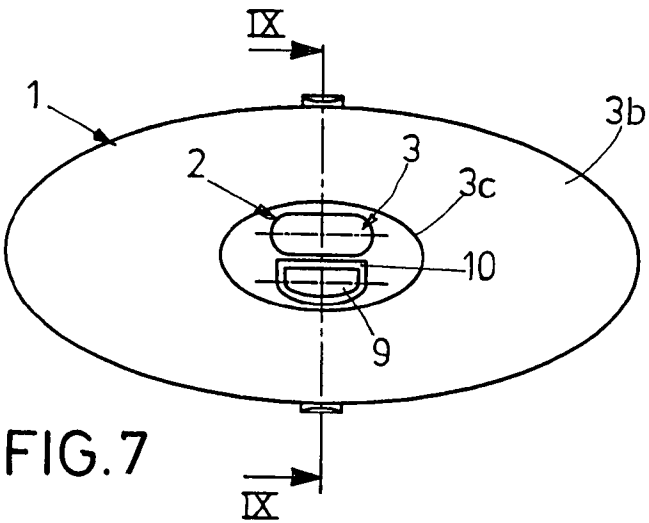
FIG. 7 is a view, similar to FIG. 1, of another container and applicator unit.

FIGS. 7 to 9 illustrate a third embodiment of a container and applicator unit. Provision is made for only a single applicator tip 3 in the form of a bunch of fibers, which otherwise corresponds to an individual applicator tip 3 of the first embodiment. In this third embodiment, a single passage 9 replaces the three passages. On the part of the applicator, it mouthes into a wedge-shaped passage section 10 by the side of the applicator tip 3. The passage section 10 is skewed in such a way that its maximum length is directly contiguous to the applicator tip 3. It stands out from the projection 3*c* to such an extent that the passage 9 ends at approximately half the length of the individual fibers 4 of the applicator tip 3. While running through the projection 3*c* and the base 3*b*, the passage 9 curves in the shape of an S, discharging centrally into the base 3*b* between the two cutting edges 8. As seen in FIG. 7, the passage 9 has a cross-sectional shape of a D in the vicinity of the passage section 10.

Upon use of this third embodiment, the substance is at first discharged via the passage 9 in the vicinity of the free ends of the individual fibers 4. This enables the substance to be uniformly spread on the tips of the individual fibers 4.

Instead of being composed of individual fibers, the applicator tip 3 may also consist of the materials specified above in conjunction with the second embodiment.

Figure 12:
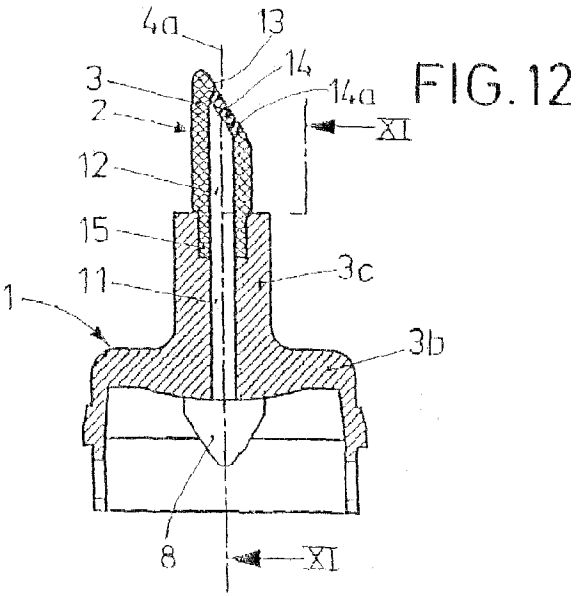
FIG. 12 is a section on the line XII-XII of FIG. 10.
Figure 11:
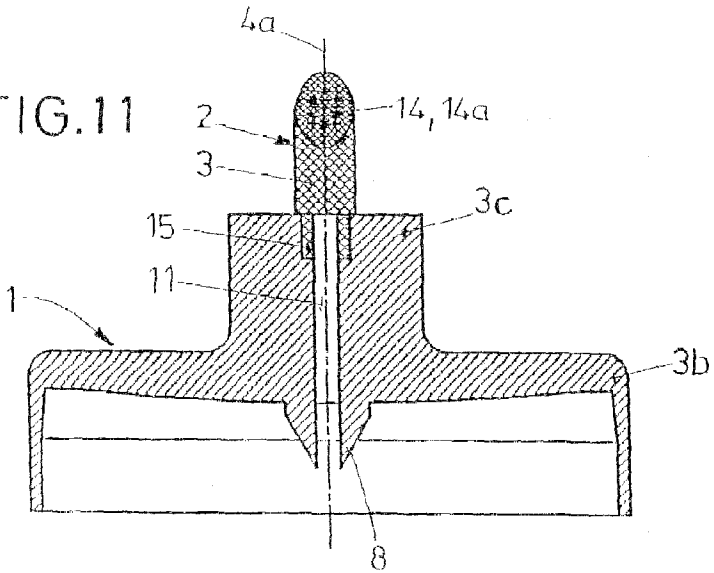
FIG. 11 is a section on the line XI-XI of FIG. 12.
Figure 10:
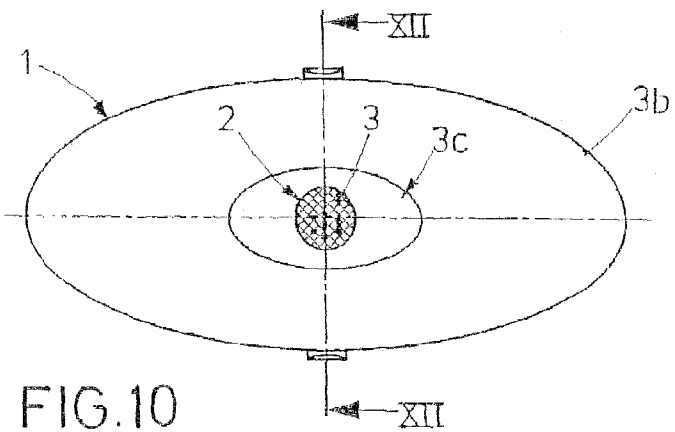
FIG. 10 is a view, similar to FIG. 1, of another container and applicator unit.

FIGS. 10 to 12 show a fourth embodiment of a container and applicator unit. In this case, a principal passage 11, which is provided centrally in the base 3*b* and projection 3*c*, comprises a passage section 12 which, by analogy to the passage 9 of the third embodiment, stands out from the projection 3*c* and the free end of which is wedge-shaped. In the fourth embodiment, the applicator 2 is placed on the passage section 12. The surface of the applicator 2 may be treated or coated with an antiadhesive layer such as Teflon (PTFE).

The applicator 2 is a sleeve with an end wall 13 of a skew complementary to the skewed end of the principal passage 11. The end wall 13 is provided with a plurality of individual passages 14 that continue the principal passage 11 outwards through the end wall 13. Apart from a central individual passage 14, the individual passages 14*a* are decentralized in relation to center line 4*a* of the applicator 2 that coincides with the longitudinal axis of the cylindrical jacket of the applicator 2.

In the fourth embodiment, the applicator 2 is fitted by a collar 15, on the side of the top, into a corresponding groove of the projection 3*c*. It is composed of one of the materials that have been described above in conjunction with the second embodiment. The number of individual passages can vary from two to twenty. In keeping with a modified design of the fourth embodiment, they may be covered by thin plastic membranes which can be removed by a user prior to using the container and applicator unit.

Figure 15:
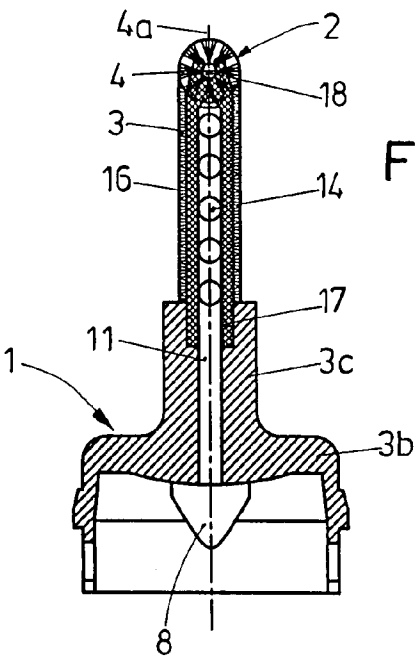
FIG. 15 is a section on the line XV-XV of FIG. 13.
Figure 14:
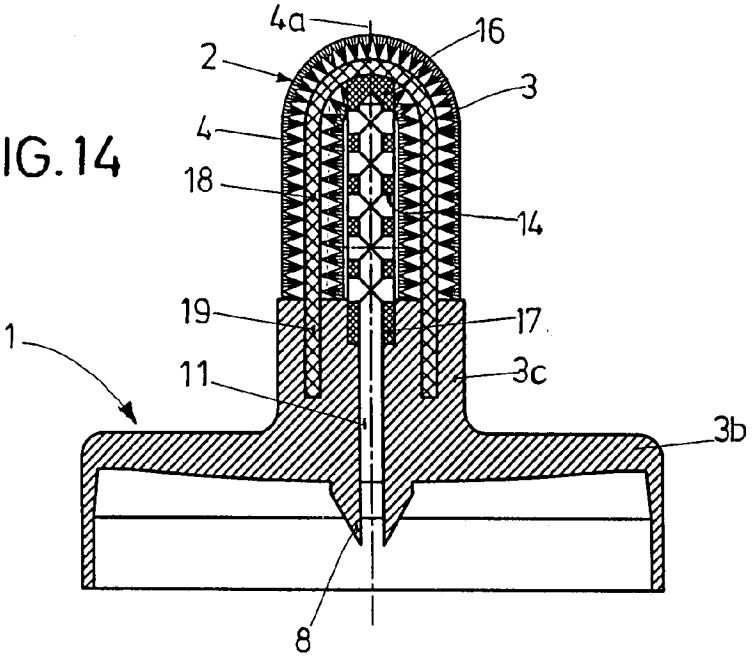
FIG. 14 is a section on the line XIV-XIV of FIG. 13.
Figure 13:
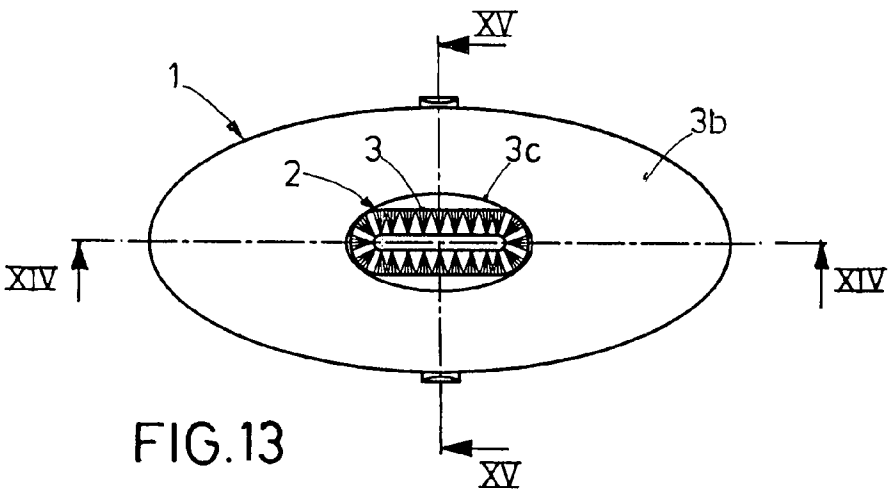
FIG. 13 is a view, similar to FIG. 1, of another container and applicator unit.
Figure 19:
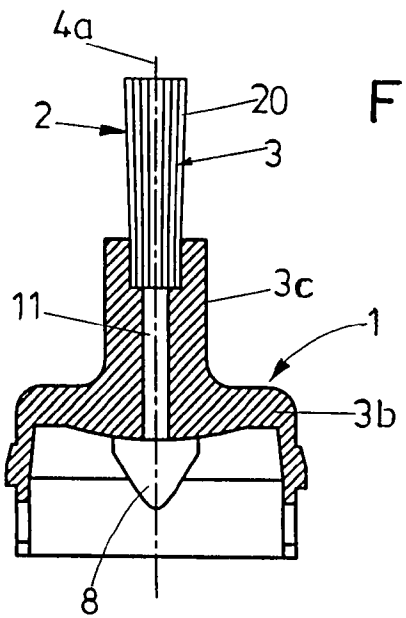
FIG. 19 is a sectional view on the line XIX-XIX of FIG. 16
Figure 18:
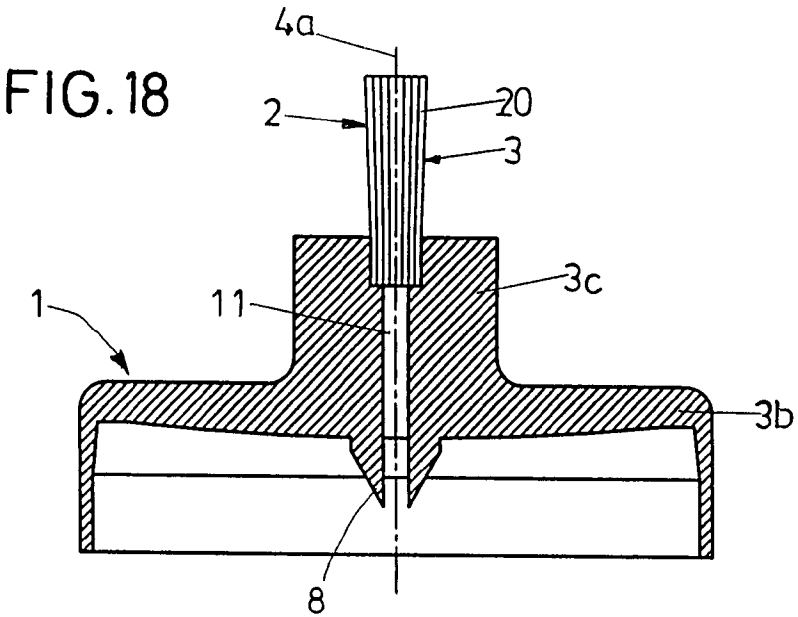
FIG. 18 is a sectional view on the line XVIII-XVIII of FIG. 16.

FIGS. 13 to 15 illustrate a fifth embodiment of a container and applicator unit. In this case, the principal passage 11 branches into a multiplicity of horizontal individual passages 14 in the form of side cuts. They are produced in a passage top 16 which, towards the applicator top 1, is placed by a collar 17 into a corresponding groove of the projection 3*c*.

The passage top 16 is enveloped by an applicator 2 which is bent in the shape of a U and comprises a U-shaped wire core 18 that is inserted into corresponding blind holes 19 of the projection 3*c*; and by radially extending, individual fibers in such a way that the individual passages 14 discharge in a direction towards the individual fibers 4, this kind of design ensuring uniform application.

Figure 17:
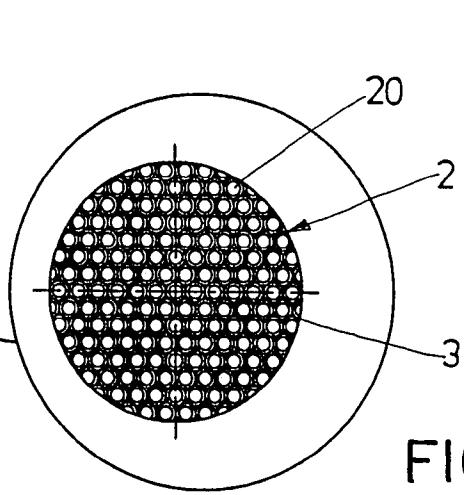
FIG. 17 is detailed view, on an enlarged scale, of FIG. 16.
Figure 16:
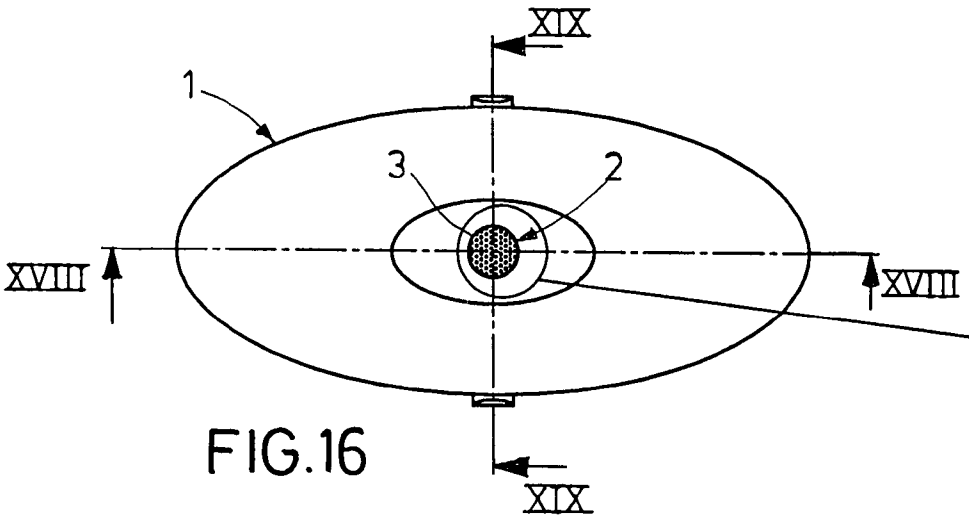
FIG. 16 is a view, similar to FIG. 1, of another container and applicator unit.

FIGS. 16 to 19 illustrate a sixth embodiment of a container and applicator unit. In this embodiment, the applicator tip 3 is formed by a multiplicity of hollow fibers 20 instead of solid individual fibers 4, the hollow fibers 20 constituting individual passages that continue the principal passage 11. The surfaces of the tips of the hollow fibers can be treated or coated with an anti-adhesive layer, for example Teflon (PTFE). FIG. 17 shows the round cross-sectional shape of the individual hollow fibers 20. By alternative, other cross-sectional shapes of the individual hollow fibers 20 are conceivable, for instance in the form of three capillaries that run in their longitudinal direction and are separated from each other by corresponding parting walls of plurally rotationally symmetrical arrangement. Any other number of capillaries per hollow fiber is possible too. The hollow fibers 20 can also have an elliptical cross-sectional shape. Instead of a hollow fiber with a closed outer wall, provision can be made for an individual fiber of sheet material that curves in the cross-section shape of an S, with this curvature providing, for the substance that is to be spread, two parallel passages that are closed, except for a narrow aperture. The applicator tip 3 of the sixth embodiment is round, but it can also be flat, rectangular or in the shape of a stadium. Alternatively or additionally, it can be skewed in the shape of a wedge, as described for example in connection with the fourth embodiment.

What is claimed is:

1. A container and applicator unit comprising a container for a cosmetic; an applicator top (1) that is placed on the container, having an applicator (2) which extends out therefrom wherein the applicator (2) comprises only a plurality of separate fibers (20) engaged to each other at an upper side of the applicator top, wherein all of said fibers are hollow and each serve as an extension of a passage through the applicator top from an inside of said container and have a plurality of decentralized outlets, wherein free ends of all of said fibers are aligned in the same plane to form a common application surface which is inclined to the longitudinal axis of the applicator so that a free end of the applicator is wedge shaped, wherein two wedge shaped cutting edges formed as a unit with he applicator top extend down from a bottom side of said applicator top, pierce a perforated upper wall on the container and form a lower part of the passage from the inside of said container through the applicator top into said hollow fiber, and wherein a central axis of the fibers, the passage and the cutting edges are coaxial with the longitudinal axis (4*a*) of the applicator unit.

2. A container and applicator unit according to claim 1, wherein the applicator (2) comprises a plurality of individual fibers (4), with at least the free ends of the individual fibers (4) being treated.

3. A container and applicator unit according to claim 1, wherein the applicator (2) comprises a plurality of individual fibers (4), with at least the free ends of the individual fibers (4) being coated.

4. A container and applicator unit according to claim 1, wherein the applicator (2) comprises a plurality of individual fibers (4), with at least the free ends of the individual fibers (4) having an anti-adhesive layer.

5. A container and applicator unit according to claim 4, wherein the anti-adhesive is Teflon (PTFE).

6. A container and applicator unit according to claim 1, wherein the applicator unit is a test unit.

* * * * *